US005176426A

United States Patent [19]

Adamson

[11] Patent Number: 5,176,426

[45] Date of Patent: Jan. 5, 1993

[54] CONCRETE GROOVING APPARATUS

[76] Inventor: Darrel M. Adamson, 918 Plum Tree La., Sarasota, Fla. 34243

[21] Appl. No.: 819,791

[22] Filed: Jan. 13, 1992

[51] Int. Cl.[5] ..... E01C 23/09

[52] U.S. Cl. ..... 299/39; 125/14; 404/90

[58] Field of Search ..... 404/90, 94; 299/39; 51/176; 125/14

[56] References Cited

U.S. PATENT DOCUMENTS

| | | | |
|---|---|---|---|
| 2,768,821 | 10/1956 | Hedlund et al. | 299/39 X |
| 4,256,344 | 3/1981 | Hatcher | 299/39 |
| 4,764,051 | 8/1988 | Whitney | 404/94 X |
| 4,792,190 | 12/1988 | Bertrand | 404/90 X |
| 4,817,581 | 4/1989 | Trentadue | 125/14 |

*Primary Examiner*—David J. Bagnell
*Attorney, Agent, or Firm*—Charles J. Prescott

[57] ABSTRACT

An apparatus for cutting a decorative grooved pattern into the surface of hardened concrete, pavement or the like. The patterns are comprised of spaced concentric circles or arcuate segments or spaced linear grooves with or without selectively positioned radial or straight groove segments therebetween and variations and combinations of each. The apparatus includes either a transversely oriented frame-mounted concrete cutting means and/or a longitudinally oriented frame-mounted concrete cutting means. An arcuate tracking arrangement and a linear tracking arrangement are also provided, each connectable to the ground or concrete working surface and, at one end thereof, to the frame. The frame may be manually or drive wheel-propelled as guided by either of the tracking arrangements to produce the above-described decorative grooved patterns in the concrete surface.

14 Claims, 4 Drawing Sheets

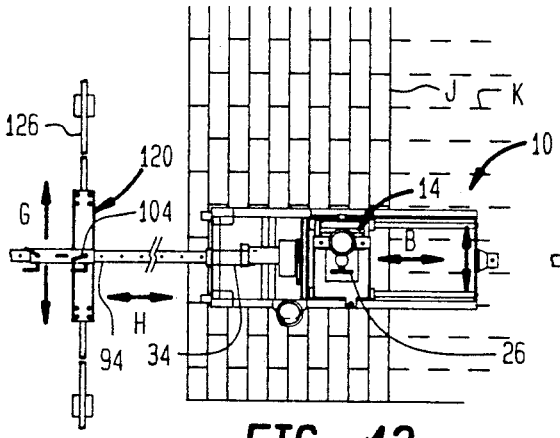
FIG. 12
FIG. 11
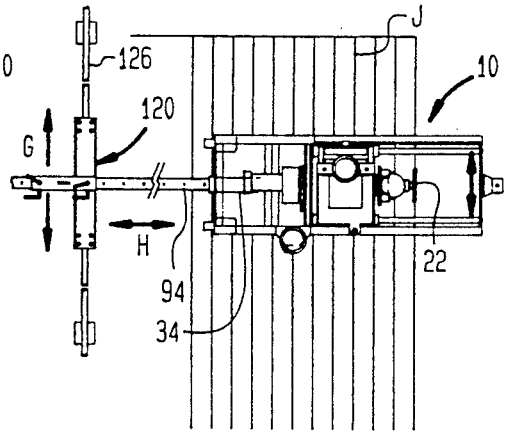
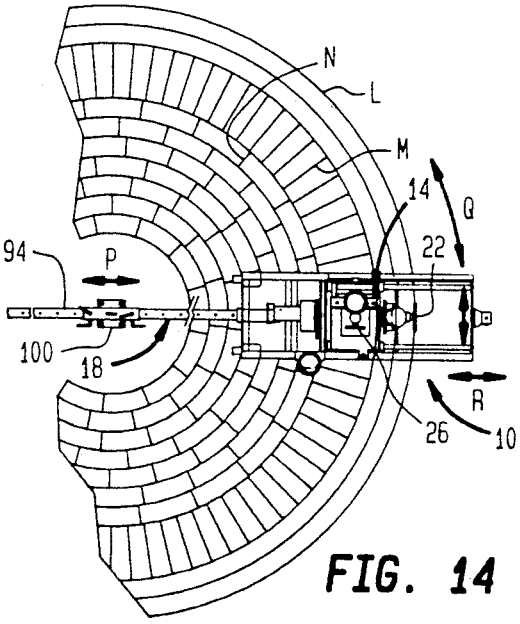
FIG. 14
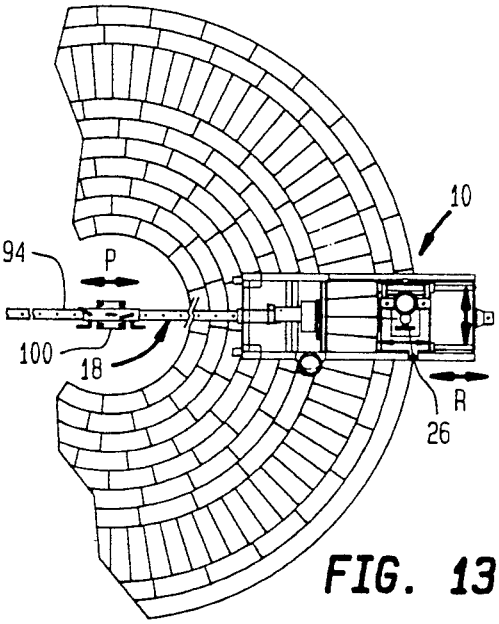
FIG. 13
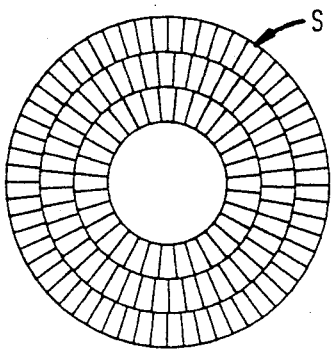
FIG. 15
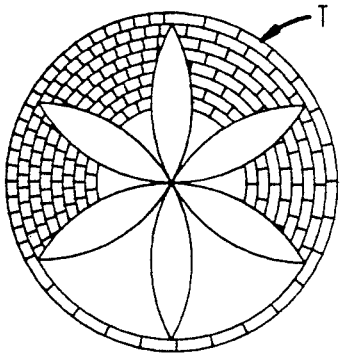
FIG. 16
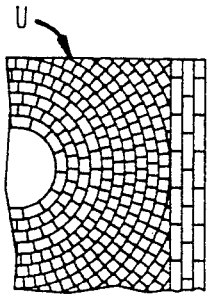
FIG. 17

CONCRETE GROOVING APPARATUS

BACKGROUND OF THE INVENTION

This invention is generally related to apparatus for cutting a groove in hardened concrete or pavement or similar surfaces, and more particularly to such a device in combination with an anchorable means for controllably guiding the device to produce decorative patterns in such surfaces.

It has become fashionable to add a decorative touch or accent to driveways and other concrete surfaces surrounding a dwelling or office building. Some types of decorative designs are applied into concrete surfaces during the curing process prior to hardening. Another type of decorative design is formed into already hardened concrete surfaces by cutting or grooving. Yet another form of patterned application is accomplished by adding an additional layer of hardenable material atop the concrete surface into which the decorative design is applied or is created thereby.

A number of devices are known to applicant which will cut or grind a groove or slot into a hardened surface of a concrete, asphalt, pavement or the like as follows:

| | |
|---|---|
| Mitrovich | 1,411,864 |
| Bardol | 1,553,845 |
| Ashback | 2,931,634 |
| Lewis | 2,934,327 |
| Zuzelo | 3,301,601 |
| Mooney | 3,617,091 |
| Shatwell | 3,663,060 |
| Zuzelo | 3,747,981 |
| Ward | 4,236,356 |
| Santschi | 4,375,212 |
| Due | 4,456,303 |

However, none of these devices offer a means for controllably guiding the cutting blade in any other than a linear pattern in the form of support wheels themselves for these apparatus.

The multiple grooving of pavement or roadway surfaces has been addressed for the purpose of either smoothing or improving the surface adhesion of such roadways to vehicle tires and are described in the following U.S. Pats.:

| | |
|---|---|
| Mori | 3,572,842 |
| Hughes | 3,606,469 |
| Hatcher | 3,724,900 |
| Hatcher | 3,779,608 |
| Staab | 3,796,462 |
| Ellis | 3,868,146 |
| Ellis | 3,896,989 |
| Ellis | 3,902,760 |
| Meister | 4,986,604 |

A number of U.S. Pats. have also been directed to the application of decorative designs into an uncured concrete surface and are disclosed in their various forms as follows:

| | |
|---|---|
| Bowman | 3,406,618 |
| Bowman | 3,939,740 |
| Chiuminatta | 4,769,201 |

Unpatented processes are also known in prior art. One such technique is commercially available through Spray-Crete of Tampa Bay, Florida, which utilizes a texturable over spray applied atop an existing concrete surface. Yet another broad range of design finish techniques are also available through Portland Cement Association of Skokie, Illinois, all of which are directed to the textured surfacing of uncured concrete surfaces.

The present invention provides an economical means for forming grooves in existing concrete without the need for adding additional thickness of topcoat material atop an existing concrete surface and also provides a broad variety of both arcuate and linear geometric grooved patterns which may be custom designed in accordance with the imagination of the operator of the invention.

BRIEF SUMMARY OF THE INVENTION

This invention is directed to an apparatus for cutting a decorative grooved pattern into the surface of hardened concrete, pavement or the like. The patterns are comprised of spaced concentric circles or arcuate segments or spaced linear grooves with or without selectively positioned radial or straight groove segments and variations and combinations of each. The apparatus includes either a transversely oriented frame-mounted concrete cutting means and/or a longitudinally oriented frame-mounted concrete cutting means. An arcuate tracking arrangement and a linear tracking arrangement are also provided, each connectable to the ground or concrete working surface and, at one end thereof, to the frame. The frame may be manually or drive wheel propelled as guided by either of the tracking arrangements to produce the above-described decorative grooved patterns in the concrete surface.

It is therefore an object of this invention to provide an apparatus for decoratively grooving hardened concrete and like surfaces.

It is another object of this invention to provide an apparatus for decoratively grooving a concrete or the like surface in regular geometric arcuate and linear groove patterns.

It is another object of this invention to provide tracking arrangements for guiding a self-propelled apparatus for decoratively grooving hardened concrete or the like surfaces.

It is another object to provide the above invention having a wide range of adjustability and versatility in accomplishing the above objectives.

In accordance with these and other objects which will become apparent hereinafter, the instant invention will now be described with reference to the accompanying drawings.

BRIEF DESCRIPTION OF THE DRAWINGS

FIG. 11 is a top plan view of the tracking arrangement shown in FIG. 8 in combination with the apparatus shown in FIG. 1 depicted cutting spaced linear grooves.

FIG. 12 is a view similar to FIG. 11 depicting the apparatus cutting transverse grooves between the longitudinal parallel cut grooves to form a staggered brick pattern.

FIG. 13 is a top plan view of the tracking arrangement shown in FIG. 2 in combination with the apparatus shown in FIG. 1 cutting straight radial groove segments.

FIG. 14 is a view similar to FIG. 13 depicted cutting additional arcuate spaced grooves.

FIGS. 15, 16 and 17 depict various grooved patterns cut into concrete surfaces which may be achieved by the present invention.

DETAILED DESCRIPTION OF THE INVENTION

Figure 1:
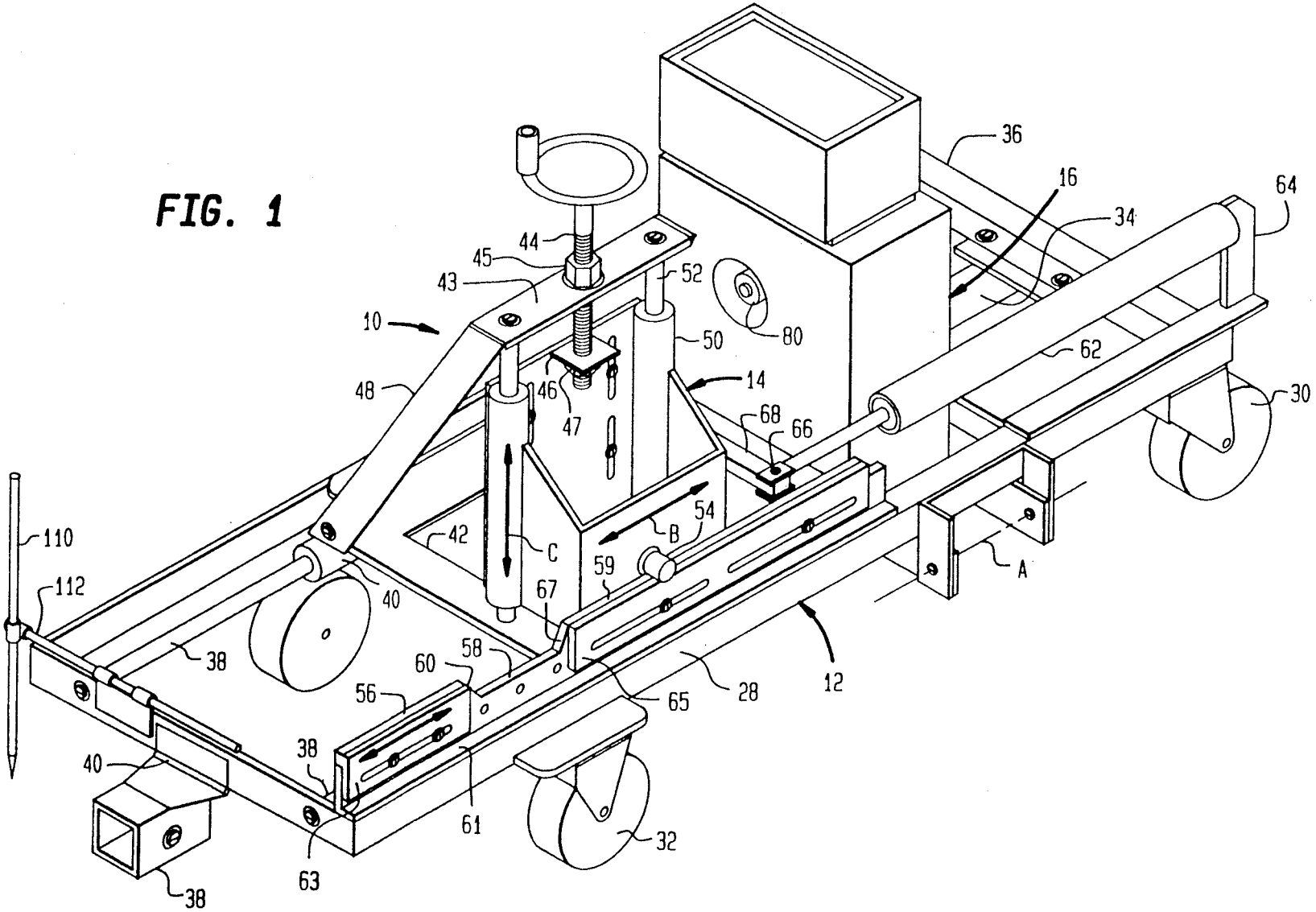
FIG. 1 is a perspective view of the invention with both circular blade cutting machines removed for clarity.

Referring now to the drawings, and particularly to FIGS. 1 and 3 to 5, the invention is there shown at numeral 10. In FIG. 1, the invention 10 is shown absent the transverse and longitudinal circular power cutting devices which are shown in position at 20 and 24, respectively in FIGS. 3, 4 and 5.

The apparatus 10 generally includes a perimeter frame 12 supported in a generally horizontal position above the ground by ground engaging front and rear caster type wheels 32 and 30, respectively.

The apparatus 10 further includes a carriage 14 and a transverse motor driven drive wheel arrangement 16. The carriage 14 is slidably mounted by spaced linear bearings 50 on upright guide rods 52 for controlled vertical movement in the direction of arrow C. These guide rods 52 are, in turn, rigidly held between horizontal plate 42 and braces 48.

Base plate 42 is rigidly connected to spaced linear bearings 40 which are mounted for fore and aft axial translation only over cylindrical guide rods 38 connected longitudinally along each side of frame 12 as shown. By this arrangement, carriage 14 will also translate fore and aft in the direction of arrow B.

To move carriage 14 back and forth in the direction of arrow B, a pneumatic cylinder 62 is provided which is connected by clevis 66 to brace 68 of carriage 14 at its forward end and rigidly connected to bracket 64 of frame 12 at its rearward end. By this arrangement, then, a broad range of longitudinal movement in the direction of arrow B of carriage 14 is available for controlling the positioning of cutting machine 24 so that its circular blade 26 defining an upright longitudinal plane is likewise controlled.

To effect the overall vertical positioning of carriage 14 in the direction of arrow C, a manually operated screw jack arrangement 44 is provided. This jack screw arrangement 44 rotatably acts between fixed jam nut 45 connected to cross bar 43 and adjustable stop nut 47 acting against plate 46 rigidly connected to carriage 14. Thus, downward movement of carriage 14 is expressly limited by jam nut 47, while the carriage 14 is free to float upwardly as required and described herebelow.

In order to provide discrete radial groove placement between arcuately cut grooves and transverse groove placement between spaced linear grooves as will be described herebelow, the carriage 14 must also controlledly and for limited distances in the direction of arrow B move vertically in the direction of arrow C so that the longitudinal cutting tool 24 and its rotatably driven circular cutting blade 26 will so respond. To accomplish this, a cam follower 54 is rigidly connected for rotation only about its transverse axis to carriage 14. This cam follower 54 then supports the entire carriage 14 by bearing upon surfaces 56, 58 and 59, depending upon the fore and aft positioning of cam follower 54. Surface 56 is defined by a linear cam 63, support surface 59 is defined by linear cam 65, while support surface 58 is defined by the upright flange margin of angle bracket 61. Both linear cams 63 and 65 are movably positionable and lockable independently back and forth in the direction of the respective arrows. Thus, by this arrangement, as pneumatic cylinder 62 drives carriage 14 forwardly in the direction of arrow B, cam follower 54 allows the carriage 14 to drop momentarily a distance equal to the length of surface 58 and a depth equal to the upright difference in height between surfaces 56/59 and 58. Lead-in ramps 60 and 67 soften and smooth this movement. Alternately, an upright shock absorber may be utilized to soften and dampen this transition.

It should be understood that either of the cutting devices 20 or 24 may be controlled for vertical positioning by controlled adjustment of the screw jack 44. Additionally, the longitudinally oriented cutting device 24 may have its circular blade 26 discretely lowered into the concrete surface to be cut a distance and depth as controlled by the linear cam arrangement as just described. Cutting device 24 may also be repositioned so that circular blade 26 is aligned with the longitudinal axis of frame 12.

An operator's seat 90 and a control housing 88 for enclosing the control circuitry are also provided.

Figure 3:
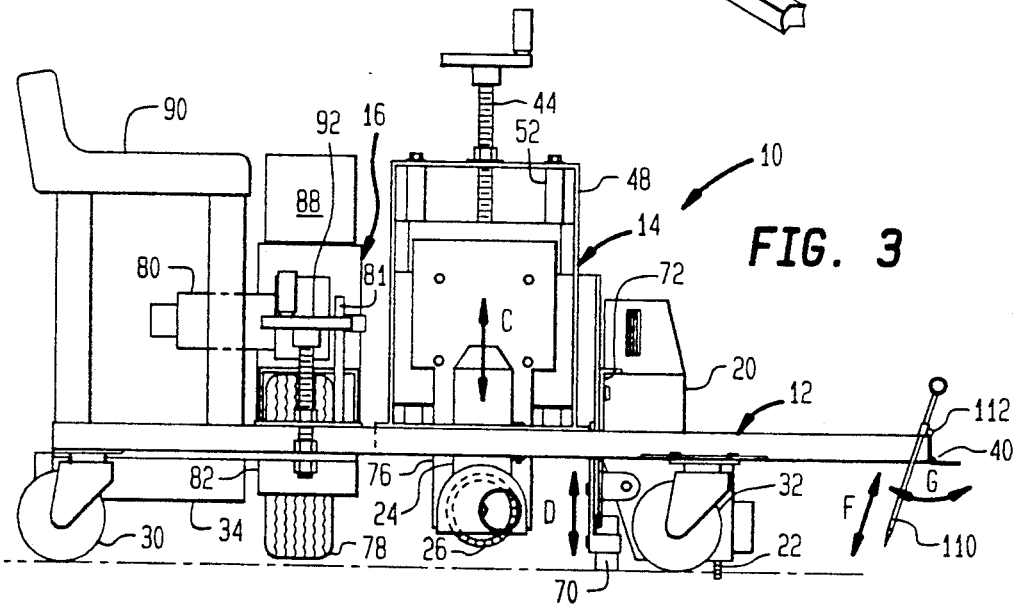
FIG. 3 is a side elevation view of FIG. 1 with both circular blade cutting machines installed.
Figure 4:
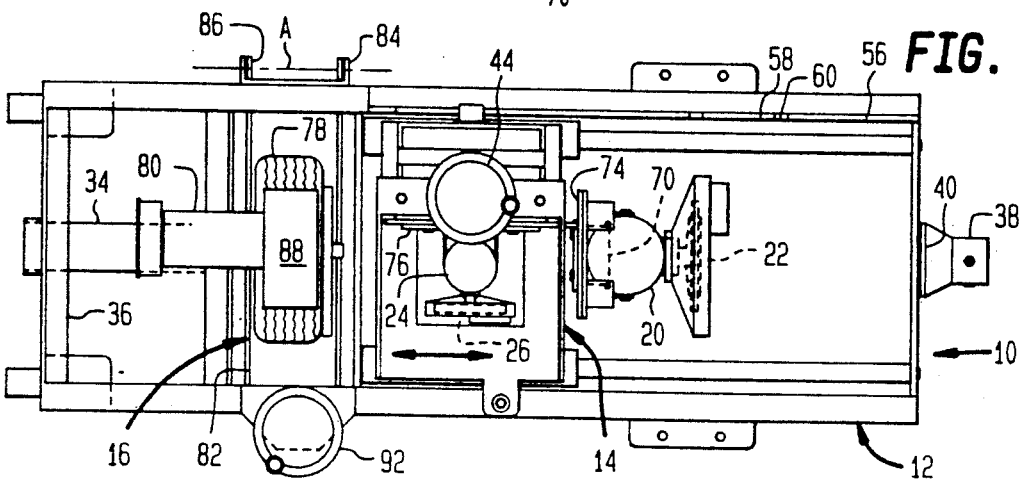
FIG. 4 is a top plan view of FIG. 3.

As seen in FIGS. 3 and 4, the transverse cutting device 20 and its circular cutting blade 22 are separately supported when in use by support wheel 70 which, when properly adjusted, moves the entire carriage 14 up and down in the direction of arrow D. By this arrangement, then the precise cutting depth of circular blade 22 is established and is maintained over any irregular surface.

Figure 2:
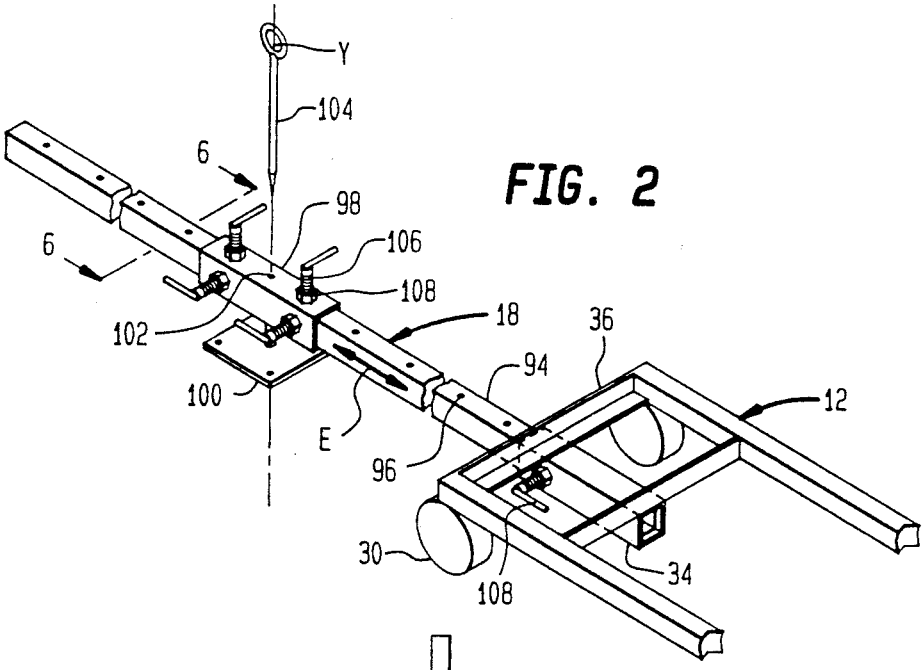
FIG. 2 is a perspective view of one embodiment of a tracking arrangement.
Figure 6:
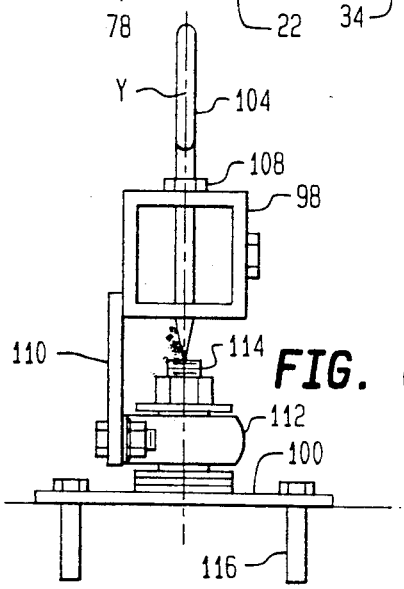
FIG. 6 is a view in the direction of arrows 6—6 in FIG. 2.
Figure 7:
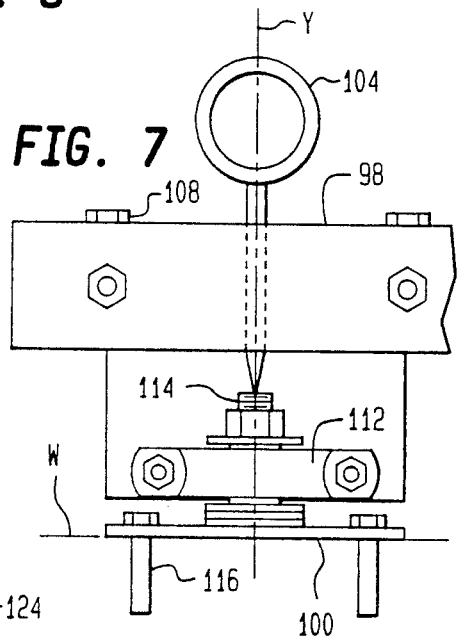
FIG. 7 is a side elevation view of FIG. 6.

Referring additionally to FIGS. 2 and 6 through 10, two tracking arrangements which controllably guide frame 12 over the concrete surface to be decoratively grooved are there shown generally at numerals 18 and 120. In FIG. 2, an arcuate tracking arrangement 18 includes an elongated connecting bar 94 having spaced thru-holes 96 in its upper and lower surfaces. This connecting bar 94 slidably engages into tube 34 of frame 12 and is secured therewithin by hand screw 106. At an intermediate point along the length of connecting bar 94, a pivot tube 98, slidably engageable thereover, is also provided and, as best seen in FIGS. 6 and 7, is pivotally securable to the concrete working surface W by first bolting plate 100 by concrete fasteners 116 to that working surface W. A bearing 112 is secured around shaft 114 for rotation of bracket 110 which supports pivot tube 98. Pin 104 then is inserted through aligned holes 102 and 96 to adjustably position the frame 12 back and forth in the direction of arrow E with respect to pivotal axis Y. By this arrangement, frame 12, supported on ground engaging casters 30 and 32, may be freely pivoted about axis Y. The selected positioning of connecting bar 94 within pivot tube 98 is additionally secured for tightness by hand screws 106 within fixed stop nuts 108.

Figure 10:
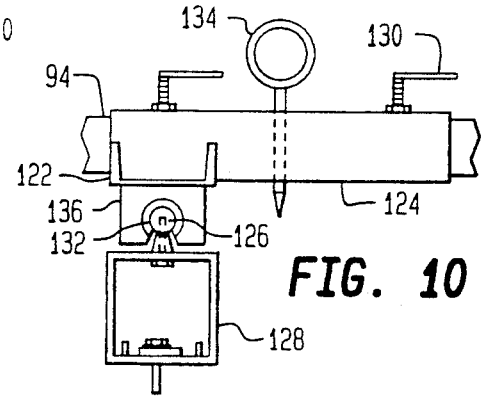
FIG. 10 is an end elevation view of FIG. 8.
Figure 8:
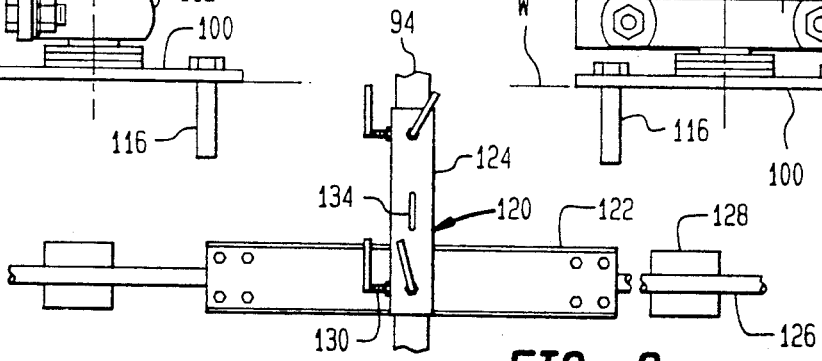
FIG. 8 is a top plan view of another embodiment of the tracking arrangement of the present invention.
Figure 9:
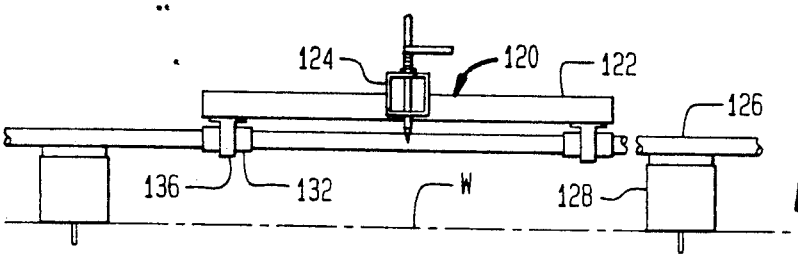
FIG. 9 is a side elevation view of FIG. 8.

The same connecting bar 94 is also utilized in the linear tracking arrangement depicted in FIGS. 8, 9 and 10 and engages by pin 134 for positioning with respect to locking tube 124, secured there tightly by hand screws 130. Locking tube 124 is rigidly connected in orthogonal relation to channel member 122 which, in turn, is rigidly connected to bearing supports 136 within which are linear bearings 132. These linear bearings 132 are held for linear sliding translation over straight cylindrical guide bar 126. This guide bar 126 is then held above the concrete working surface W by spaced standoffs 128 which are rigidly connectable into the working surface W. By this arrangement, the frame 12 is only movable transversely over the working surface W as control tube 94 is rigidly connected within tube 34 of frame 12 as previously described. Minor up and down pivotal movement of frame 12 on connecting bar 94 is accommodated by linear bearings 132 on guide bar 126 as best seen in FIG. 10.

Referring to FIGS. 11 and 12, the decorative linear grooving capability of the device 10 is there depicted. In FIG. 11, circular cutter blade 22 is utilized to cut successive straight grooves J within the concrete working surface by translating the entire apparatus 10 along guide shaft 126 in the direction of arrow G. Spacing between successive grooves J is accomplished by extending control bar 94 in the direction of arrow H and then resecuring that chosen positioning as previously described. Circular cutting blade 22 is controlled for elevation and depth of cut by adjusting jack screw 44 to elevate or lower carriage 14 as previously described and as further controlled by support wheel 70 as previously described.

In FIG. 12, after all spaced linear cuts J are accomplished, transverse groove segments K are then cut into the working surface. This is accomplished by first removing or upwardly repositioning cutting blade 22 on cutting device 20 into an out-of-service position and then adjustably lowering circular blade 26 on cutting device 24 downwardly into cutting depth position. After jack screw 44 has been adjusted for overall vertical positioning of cutting blade 26, and linear cams 63 and 65 as best seen in FIG. 1, have been adjusted fore and aft as previously described to control the width of surface 58, carriage 14 is then moved back and forth in the direction of arrow B so that cam follower 54 will controllably lower cutter blade 26 a selected length and depth a previously described. The entire arrangement 10 is moved along guide bar 126 in the direction of arrow G so as to accomplish cutting a column of spaced groove segments K between two adjacent spaced linear grooves J. Thereafter, the apparatus 10 is repositioned in the direction of arrow H by removing pin 104 and extending or retracting connecting bar 94 for resecuring within another selected locating hole.

Figure 5:
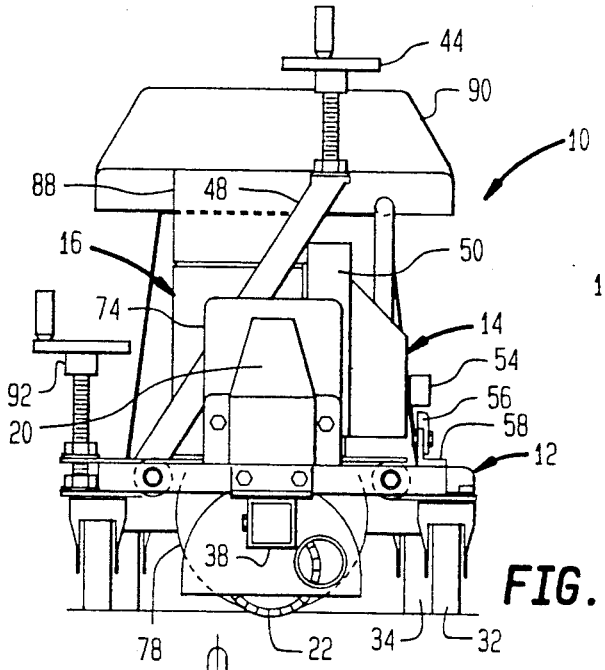
FIG. 5 is a front end elevation view of FIG. 3.

Because supported upon ground engaging casters, frame 12 may be moved manually. However, a motorized transverse drive wheel 78 as best seen in FIGS. 3, 4 and 5 within the drive arrangement 16 is also provided. This transverse drive wheel 78 is operably connected for rotation within the drive housing 16 which is itself supported and pivotally connected about axis A shown in FIG. 1 at one end and is supported at the other end by a manual jack screw arrangement 92 acting through conventional stop nuts as previously described. By this arrangement, suitable rotatable adjusting of jack screw 92 raises and lowers the drive housing 16 and drive wheel 78 therewithin about axis A. A drive motor 80 acting through a chain drive mechanism 81 controllably rotates drive wheel 78.

Referring now to FIGS. 13 and 14, the arcuate groove cutting feature of the present invention is there shown. The apparatus 10 is pivotally secured on connecting bar 94 to ground plate 100 in a preselected location as previously described. Thus, only arcuate movement of frame 12 back and forth in the direction of arrow Q is permitted. The transverse circular cutter blade 22 is first engaged into the working surface as previously described. A plurality of arcuate or circular spaced grooves L are then cut successively into the working surface, the spacing between these grooves established primarily by the locking pin interengagement of connecting bar 94 to ground plate 100 as previously described in the direction of arrow P. A limited number of arcuate grooves L may be successively cut into the working surface without the need of adjusting control arm 94 by movement of the carriage 14 in the direction of arrow R through air cylinder 62 as previously described. However, the lengthening or shortening of connecting bar 94 is generally relied upon for each repositioning of cutting blade 22. After the arcuate or circular grooves L are cut, the radial groove segments M and N are then cut between selected arcuate grooves L as desired to establish the desired decorative pattern. To accomplish this, cutting blade 22 on cutting device 20 is moved out of cutting position and longitudinal cutting blade 26 on cutting device 20 is lowered into operative cutting position as previously described.

The length of each radial groove segment M and N is controlled as previously described by the adjustment of the linear cam arrangement best seen in FIG. 1. The pivotal repositioning back and forth in the direction of arrow Q of the entire apparatus 10 is effected by activating transverse drive wheel 78 as previously described. Drive wheel 78 will also serve as a breaking and holding arrangement while each radial groove segment M or N is cut. Alternately, repositioning and holding may be done manually.

Although manual or visual "eyeballing" between either transverse groove segments K or radial groove segments M or N may be achieved, a pointer guide 110, as seen in FIG. 1, is also provided. This pointer guide 110 is held for both vertical, rotational and transverse securable repositioning on transverse shaft 112 so that it may be viewed in alignment with a previously cut groove segment to establish uniform spacing between each groove segment.

Although the connecting bar 94 is preferably lockably connected to tube 34 after longitudinal positioning within frame 12 at the rear thereof, an auxiliary receiver 38 pivotally connected by hinge 40 at the front of frame 12 is also provided. This auxiliary receiver 38 may be pivoted out of position when not in use but may be utilized when one of the transverse cutter devices 20 is positioned forwardly of the front surface of frame 12 to groove a working surface close to an upright wall or barrier of any type. The auxiliary receiver 38 accomplishes additional functions as well by permitting a pivotal break between connecting bar 94 and frame 12 to better accommodate an uneven or irregular concrete working surface. Both arcuate and linear grooves may be cut closer to the pivot axis 4 or guide bar 126 utilizing auxiliary receiver 38, which may also serve to store a length of connecting bar 94 in upright position.

It is preferred to have tube 34 rigidly connected in longitudinal alignment with frame 12. However, to accomplish askew grooves between adjacent linear and arcuate grooves J and L, respectively, tube 34 may be structured for incremental lockable misalignment with the longitudinal axis of frame 12.

A wide variety of decorative patterns comprising either arcuate and/or linear geometric grooves may be achieved by this invention 10. As seen in FIGS. 16, 17 and 18, these decorative patterns which include the either arcuate or linear grooves are almost infinitely variable depending upon the creativity of the operator.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A guided apparatus for decoratively grooving a hardened concrete surface comprising:

a frame having ground engaging support wheels;

transverse cutting means mounted on said frame for controllably cutting a groove of preselected depth in the concrete surface transversely to a longitudinal axis of said frame as said frame is moved laterally;

an arcuate tracking means having an elongated connecting bar connectable at one end to said frame and pivotally connectable at another point therealong to the ground;

said transverse cutting means cutting an arcuate groove in the concrete surface as said frame is moved in an arcuate path over the concrete surface on said connecting bar about said pivotal connection.

2. A guided concrete grooving apparatus as set forth in claim 1, further comprising:

a transversely oriented upright drive wheel operably connected to said frame and configured and operably driven by a power drive source to propel said frame in an arcuate path over the concrete surface about said pivotal connection.

3. A guided concrete grooving apparatus as set forth in claim 2, wherein:

said frame on said tracking means is adjustably positionable with respect to said pivotal connection whereby concentric arcuate grooves may be cut into the concrete surface.

4. A guided concrete grooving apparatus as set forth in claim 3, further comprising:

a radial cutting means mounted on said frame for cutting straight, radial groove segments of preselected depth and length in the concrete surface longitudinally to said frame, generally radially extending from said pivotal connection, and selectively positionable between preselected arcuate grooves.

5. A guided concrete grooving apparatus as set forth in claim 4, further comprising:

a pointer guide connected to said frame structured to provide viewable indicia to establish preselected spaced positioning of said radial cutting means between adjacent straight groove segments to be cut.

6. A guided concrete grooving apparatus as set forth in claim 2, further comprising:

a transversely oriented depth control wheel connected to and supporting said transverse cutting means and structured to engage the concrete surface to provide a uniform groove depth of said transverse cutting means into the concrete surface as said transverse cutting means moves freely up and down with respect to said frame and supported by said depth control wheel.

7. A guided concrete grooving apparatus as set forth in claim 2, further comprising:

an auxiliary means for connecting said connecting bar to said frame and positioned at the other end of said frame;

said auxiliary connecting means pivotally connected to said frame whereby said auxiliary connecting means may be pivoted upwardly from a forwardly extending in-use position to an upright stored position.

8. A guided apparatus for decoratively grooving a hardened concrete surface comprising:

a frame having ground engaging support wheels;

transverse cutting means mounted on said frame for controllably cutting a groove or preselected depth in the concrete surface transversely to a longitudinal axis of said frame as said frame is moved laterally;

a linear tracking means having an elongated rigid connecting bar connectable at one end to and generally in alignment parallel with said frame longitudinal axis and connectable for linear sliding movement only at another point therealong to a linear slide bar which is rigidly connectable parallel to the concrete surface;

said transverse cutting means cutting a linear groove in the concrete surfaces as said frame is moved across the concrete surface on said connecting bar about said sliding connection and parallel to said slide bar.

9. A guided concrete grooving apparatus as set forth in claim 8, further comprising:

a transversely oriented upright drive wheel operably connected to said frame and configured and operably driven by a power drive source to propel said frame in a straight path over the concrete surface parallel to said slide bar.

10. A guided concrete grooving apparatus as set forth in claim 9, wherein:

said frame on said connecting bar is adjustably positionable with respect to said slide bar whereby parallel spaced grooves may be cut into the concrete surface.

11. A guided concrete grooving apparatus as set forth in claim 10, further comprising:

a longitudinal cutting means mounted on said frame for cutting straight, groove segments of preselected depth and length in the concrete surface longitudinally to said frame, transversely extending and selectively positionable between preselected linear grooves.

12. A guided concrete grooving apparatus as set forth in claim 11, further comprising:

a pointer guide connected to said frame structured to provide viewable indicia to establish preselected spacing between adjacent straight groove segments.

13. A guided concrete grooving apparatus as set forth in claim 9, further comprising:

a transversely oriented depth control wheel connected to and supporting said transverse cutting means and structured to engage the concrete surface to provide a uniform groove depth of said transverse cutting means into the concrete surface as said transverse cutting means moves freely up and down with respect to said frame and supported by said depth control wheel.

14. A guided concrete grooving apparatus as set forth in claim 9, further comprising:

an auxiliary means for connecting said connecting bar to said frame and positioned at the other end of said frame;

said auxiliary connecting means pivotally connected to said frame whereby said auxiliary connecting means may be pivoted upwardly from a forwardly extending in-use position to an upright stored position.

* * * * *